US006865537B2

(12) United States Patent
Yasushi et al.

(10) Patent No.: US 6,865,537 B2
(45) Date of Patent: Mar. 8, 2005

(54) METHOD AND APPARATUS FOR REPRODUCING AUDIO INFORMATION

(75) Inventors: Mitsuo Yasushi, Saitama-ken (JP); Masatoshi Yanagidaira, Saitama-ken (JP); Kunio Yarita, Tokyo (JP)

(73) Assignees: Pioneer Corporation, Tokyo (JP); Futek Electronics Co., LTD, Tokyo (JP)

( * ) Notice: Subject to any disclaimer, the term of this patent is extended or adjusted under 35 U.S.C. 154(b) by 653 days.

(21) Appl. No.: 09/819,720

(22) Filed: Mar. 29, 2001

(65) Prior Publication Data

US 2001/0027399 A1 Oct. 4, 2001

(30) Foreign Application Priority Data

Mar. 29, 2000 (JP) ..... 2000-090827

(51) Int. Cl.[7] ..... G10L 21/00
(52) U.S. Cl. ..... 704/278; 704/275; 704/500
(58) Field of Search ..... 704/500, 503, 704/504, 278, 267, 269, 275

(56) References Cited

U.S. PATENT DOCUMENTS 5,781,885 A * 7/1998 Inoue et al. ..... 704/267
5,845,247 A * 12/1998 Miyasaka ..... 704/267
6,115,687 A * 9/2000 Tanaka et al. ..... 704/269

FOREIGN PATENT DOCUMENTS

JP 05297891 * 11/1993 ..... G10L/3/02
JP 10282963 * 10/1998 ..... G10H/7/00

OTHER PUBLICATIONS

B. Grill et al., "Information Technolofy—very low bitrate audio–visual coding," Part3: Audio, ISO/IEC FCD 14496–3 Subpart 1, May, 1998.*
A. Amir et al., "Using audio time scale modification for video browsing," Proc. 33rd Annual Hawaii International Conference on System Sciences 2000, vol. 1, Jan. 2000.*
W. Verhelst et al., "An overlap–add technique based on waveform similarity (WSOLA) for high quality time–scale modification of speech," IEEE ICASSP '93, vol. 2, pp. 554–557, Apr. 1993.*
J. Makhoul et al., "Time–scale modification in medium to low rate speech coding," IEEE ICASSP '86, vol. 11, pp. 1705–1708, Apr. 1986.*

* cited by examiner

*Primary Examiner*—Susan McFadden
(74) *Attorney, Agent, or Firm*—Arent Fox PLLC

(57) ABSTRACT

A request for reading audio information is sent to an audio information source in accordance with an amount of information accumulated in a buffer memory, a predetermined amount of audio information is read from the buffer memory in accordance with a preset speed magnification, and the predetermined amount of audio information is reproduced after undergoing a reproducing speed conversion treatment. First portions of the audio information may be successively cut out in accordance with window functions, connected together, and rendered to serve as an output for converting a reproducing speed in a first channel. Second portions of the audio information may be successively cut out in accordance with window functions, connected together, and rendered to serve as an output for converting a reproducing speed in a second channel. The audio information may be independently reproduced through the first and second channels.

5 Claims, 7 Drawing Sheets

| PRESET SPEED MAGNIFICATIONS k | SPEED MAGNIFICATION (FOR AUDIO INFORMATION) | SPEED MAGNIFICATION (FOR NON-AUDIO INFORMATION) |
|---|---|---|
| 5 | 3 | 6.6 |
| 4 | 2.8 | 5.6 |
| 3 | 2.3 | 4.14 |
| 2 | 1.5 | 2.52 |
| 1 | 1 | 1 |
| 0.8 | 0.9 | 0.81 |
| 0.5 | 0.7 | 0.42 |

FIG.4

| PRESET SPEED MAGNIFICATIONS k | SPEED MAGNIFICATION (FOR AUDIO INFORMATION) | SPEED MAGNIFICATION (FOR NON-AUDIO INFORMATION) |
|---|---|---|
| 5 | 3 | 6.6 |
| 4 | 2.8 | 5.6 |
| 3 | 2.3 | 4.14 |
| 2 | 1.5 | 2.52 |
| 1 | 1 | 1 |
| 0.8 | 0.9 | 0.81 |
| 0.5 | 0.7 | 0.42 |

METHOD AND APPARATUS FOR REPRODUCING AUDIO INFORMATION

BACKGROUND OF THE INVENTION

The present invention relates to a method of and an apparatus for reproducing audio information, particularly to an audio information reproducing method and an audio information reproducing apparatus, which are all suitable for speed-variable reproduction of an audio source as well as for changing a reproducing speed in a real time reproduction.

When an audio signal is to be reproduced slowly or quickly, the audio data is usually extended or compressed in the direction of a time axis. Namely, when an audio signal is to be reproduced slowly, the time is extended. On the other hand, when an audio signal is to be reproduced quickly, the time is compressed. In this way, when the reproduction is made slow, the tone of a sound becomes low. On the other hand, when the reproduction is made quick, the tone of sound becomes high.

In order to stabilize the tone of a sound so as to keep it at a constant value, the wave form of an original signal may be partially cut out and extended or compressed in the direction of a time axis, and then connected together so as to make constant an entire time length. However, since discontinuous signals are to be connected together in such a process, some sharp pulses will occur at some joint positions.

A procedure for carrying out the above process is shown in FIG. 6. Namely, segments of the wave form of an original signal are cut out, compressed or extended in the time axis, and further attenuated to smooth both ends of each signal by applying window functions. In detail, since each window function itself presents a mountain-like waveform and is thus symmetrical left and right (with both sides of each function signal being attenuated), a resulting waveform obtained by applying the window functions to the original signal will also be smoothly attenuated on both sides thereof. Therefore, if segments of the resulting signal are each retarded a little when being overlapped one upon another (so as to be connected together), it is possible to obtain a smooth and continuous signal not involving any seam joints.

However, in the above described prior art, when the segments of waveform are overlapped upon one another, it has been found that some modulation waves will occur and undesired low frequency wave will be generated. Further, it has been found that a smaller interval between adjacent overlapped segments will cause a larger modulation wave. Moreover, since the waveforms are overlapped upon one another, some mutually adjacent signals will be overlapped together, undesirably producing a sound involving an echo. Although this does not cause severe problem when an information data is music data, the clarity of the audio data will be deteriorated. On the other hand, if an interval between adjacent overlapped segments is too large, reverberation sound will be undesirably beard, thus causing a deterioration in the clarity of audio data.

SUMMARY OF THE INVENTION

The present invention has been accomplished in view of the above problem, its object is to provide an improved method of and an improved apparatus for reproducing audio information. Namely, audio information read from an audio information source is at first stored in a buffer memory, the stored audio information is then read out at a preset speed magnification, and reproduced upon receiving a reproducing speed conversion treatment. The method comprises sending a request for reading audio information to the audio information source in accordance with an amount of information accumulated in the buffer memory; reading a predetermined amount of audio information from the buffer memory in accordance with the preset speed magnification, and reproducing the predetermined amount of audio information after performing a reproducing speed conversion treatment on the audio information. Thus, an object of the present invention is to provide an improved method of and an improved apparatus for reproducing audio information, which can ensure an improved recognizability for bearing a reproduced audio information and allows a reduction in the capacity of a buffer memory.

Further, another object of the present invention is to provide an improved method of and an improved apparatus for reproducing audio information, capable of reducing an information cutting amount and improving a recognizability for hearing a reproduced audio information. Namely, the method comprises cutting out, successively and in accordance with window functions, first portions of the audio information, connecting together the first portions, and rendering the mutually connected first portions to serve as an output for converting a reproducing speed in a first channel; cutting out, in accordance with window functions, second portions of the audio information, connecting together the second portions, and rendering the mutually connected second portions to serve as an output for converting a reproducing speed in a second channel; and reproducing the audio information independently through the first and second channels.

To achieve the above objects of the invention, there is provided an audio information reproducing method wherein audio information read from an audio information source is at first stored in a buffer memory, the stored audio information is then read out at a preset speed magnification, and reproduced upon receiving a reproducing speed conversion treatment, said method comprising: sending a request for reading audio information to the audio information source in accordance with an amount of information accumulated in the buffer memory; reading a predetermined amount of audio information from the buffer memory in accordance with the preset speed magnification, and reproducing the predetermined amount of audio information after performing a reproducing speed conversion treatment on the audio information.

In this way, the method comprises sending a request for reading audio information to the audio information source in accordance with an amount of information accumulated in the buffer memory; reading a predetermined amount of audio information from the buffer memory in accordance with the preset speed magnification, and reproducing the predetermined amount of audio information after performing a reproducing speed conversion treatment on the audio information. Therefore, it becomes possible to improve the recognizability for hearing a reproduced audio information and allows a reduction in the capacity of a buffer memory.

Further, according to the present invention, there is provided an audio information reproducing method wherein audio information read from an audio information source is at first stored in a buffer memory, the stored audio information is then read out at a preset speed magnification, and reproduced upon receiving a reproducing speed conversion treatment, said method comprising: cutting out, successively and in accordance with window functions, first portions of the audio information, connecting together the first portions, and rendering the mutually connected first portions to serve as an output for converting a reproducing speed in a first channel; cutting out, in accordance with window functions, second portions of the audio information, connecting together the second portions, and rendering the mutually connected second portions to serve as an output for converting a reproducing speed in a second channel; and reproducing the audio information independently through the first and second channels.

In another aspect of the present invention, the first portions and the second portions of the audio information are variable in their extension/compression rates in accordance with the amplitudes of these portions.

In this way, the method comprises cutting out, successively and in accordance with window functions, first portions of the audio information, connecting together the first portions, and rendering the mutually connected first portions to serve as an output for converting a reproducing speed in a first channel; cutting out, in accordance with window functions, second portions of the audio information, connecting together the second portions, and rendering the mutually connected second portions to serve as an output for converting a reproducing speed in a second channel; and reproducing the audio information independently through the first and second channels. Therefore, it becomes possible to reduce an information cutting amount and improve a recognizability for hearing a reproduced audio information.

In a further aspect of the present invention, there is provided an audio information reproducing apparatus comprising: an audio information source; a buffer memory for storing audio information read from the audio information source; speed magnification setting means for setting a reproducing speed magnification for use in reading the audio information stored in the buffer memory; and signal processing means capable of sending a request for reading audio information to the audio information source in accordance with an amount of information accumulated in the buffer memory, reading a predetermined amount of audio information from the buffer memory in accordance with the preset speed magnification, and reproducing the predetermined amount of audio information after performing a reproducing speed conversion treatment on the audio information.

In this way, the invention comprises sending a request for reading audio information to the audio information source in accordance with an amount of information accumulated in the buffer memory; reading a predetermined amount of audio information from the buffer memory in accordance with the preset speed magnification, and reproducing the predetermined amount of audio information after performing a reproducing speed conversion treatment on the audio information. Therefore, it becomes possible to improve the recognizability for hearing a reproduced audio information and allows a reduction in the capacity of a buffer memory. Further, the present invention is suitable for use with an audio information recording and reproducing source, as well as suitable for a real-time reproducing speed conversion. Namely, the invention is suitable for various trainings which require an audio information to be reproduced at first at a low speed and then the reproducing speed be gradually increased, thereby enabling a person to more easily hear his or her desired reproduced sound.

In a still further aspect of the present invention, there is provided an audio information reproducing apparatus comprising: an audio information source; a buffer memory for storing audio information read from the audio information source in accordance with a speed magnification; and signal processing means capable of i) cutting out, successively and in accordance with window functions, first portions of the audio information, connecting together the first portions, and rendering the mutually connected first portions to serve as an output for converting a reproducing speed in a first channel, ii) cutting out, in accordance with window functions, second portions of the audio information, connecting together the second portions, and rendering the mutually connected second portions to serve as an output for converting a reproducing speed in a second channel, and iii) reproducing the audio information independently through the first and second channels.

In this way, the method comprises cutting out, successively and in accordance with window functions, first portions of the audio information, connecting together the first portions, and rendering the mutually connected first portions to serve as an output for converting a reproducing speed in a first channel; cutting out, in accordance with window functions, second portions of the audio information, connecting together the second portions, and rendering the mutually connected second portions to serve as an output for converting a reproducing speed in a second channel; and reproducing the audio information independently through the first and second channels. Therefore, it becomes possible to reduce an information cutting amount and improve a recognizability for hearing a reproduced audio information. Further, the present invention is suitable for use with an audio information recording and reproducing source, as well as suitable for a real-time reproducing speed conversion. Namely, the invention is suitable for various trainings which require an audio information to be reproduced at first at a low speed and then the reproducing speed be gradually increased, thereby enabling a person to more easily hear his or her desired reproduced sound.

The above objects and features of the present invention will become better understood from the following description with reference to the accompanying drawings.

BRIEF DESCRIPTION OF DRAWINGS

FIG. 4 is a table showing the operation of an embodiment of the present invention, indicating a relationship among externally preset speed magnification, speed magnification for audio information, and speed magnification for non-audio information.

DETAILED DESCRIPTION OF THE PREFERRED EMBODIMENTS

Figure 1:
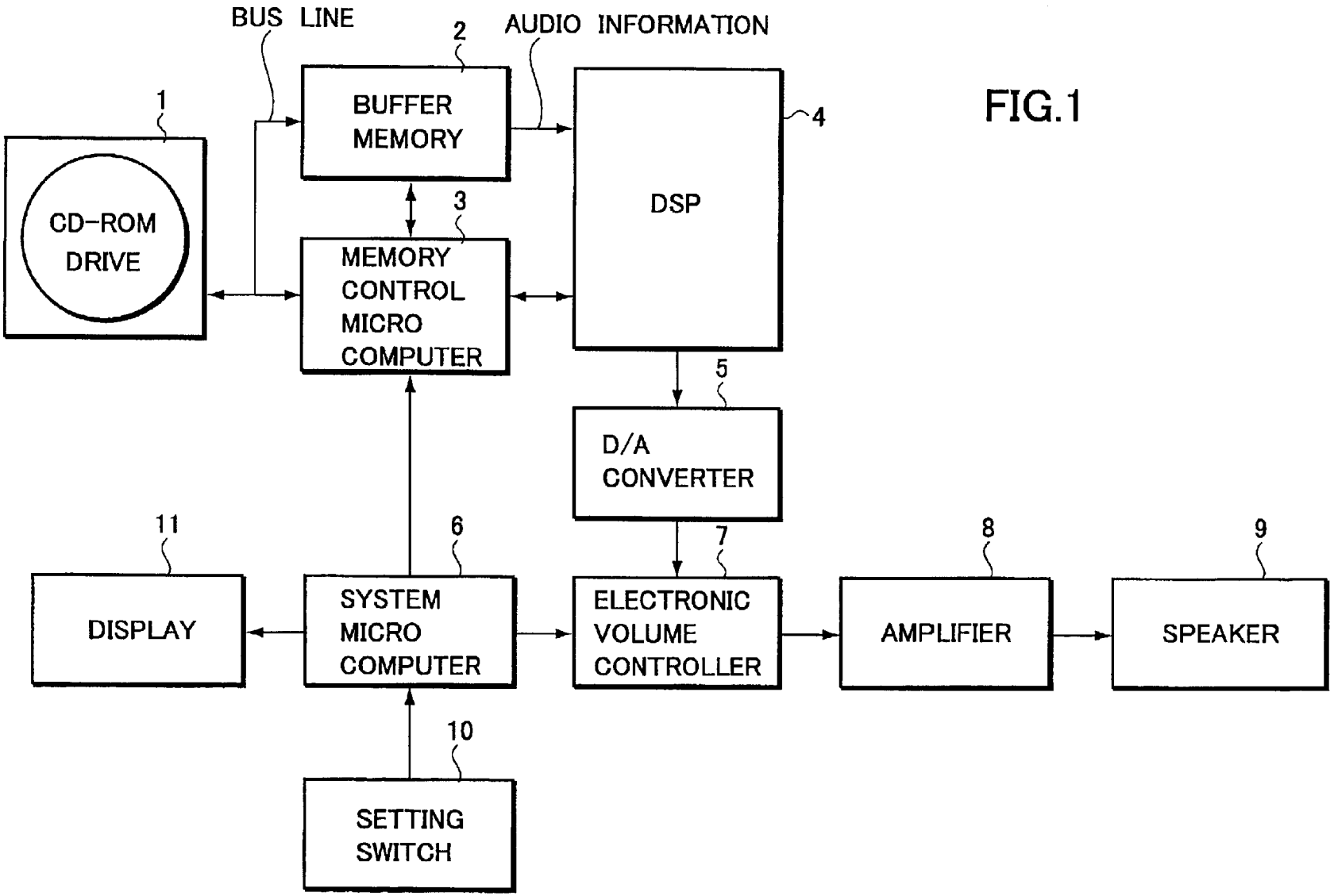
FIG. 1 is a block diagram showing one embodiment of the present invention.

FIG. 1 is a block diagram showing one embodiment of an audio information reproducing apparatus formed according to the present invention.

As shown in the drawing, the audio information reproducing apparatus comprises a CD-ROM drive 1, a buffer memory 2, a memory control micro computer 3, a DSP (Digital Signal Processor) 4, a D/A (Digital-Analogue) converter 5, a system micro computer 6, an electronic volume controller 7, an amplifier 8, a speaker 9, a setting switch 10 and a display 11.

Here, an audio information source is a CD-ROM drive 1 capable of reading an audio information at a speed which is 8 times as fast as an original speed. Using such a constitution, a setting switch 10 is at first operated to set a reproducing speed (speed magnification of N) and a sound volume. The system micro computer 6 is provided to receive these newly set informations, with speed information being fed to the memory control micro computer 3 and a newly set speed value being indicated on the display 11. Meanwhile, a newly set volume value is fed to the electronic volume controller 7.

Here, the memory control micro computer 3 produces an instruction of speed magnification of N (0.5–5) to the DSP 4, an audio information is read from the CD-ROM drive 1 at an average speed magnification of N and then written in the buffer memory 2. Further, in accordance with an instruction from the memory control micro computer 3, an audio information is fed from the buffer memory 2 to the DSP 4. Then, an amplitude of the audio information fed into the DSP 4 is calculated, and a compression/extension treatment along a time axis is performed in accordance with the calculated amplitude, with the result of the compression/extension treatment being produced to the D/A converter 5. The output of the D/A converter 5 is fed through the electronic volume controller 7 to the amplifier 8 so as to be amplified in the amplifier 8, thus driving the speaker 9.

Here, since the reproducing speed is variable in accordance with the feature (audio signal or non-audio signal) of a signal component, the DSP 4 can determine a transfer speed of a next audio information in accordance with the amplitude of the signal, and send a speed information (M times: 0.42 to 6.6) to the memory control micro computer 3. In this way, the memory control micro computer 3 can read audio information from the CD-ROM drive 1 at a speed magnification of M and send the information to the DSP 4 by way of the buffer memory 2. In practice, the DSP 4 is provided to repeat the calculation of the amplitude of an audio information fed through the buffer memory 2, as well as the compression/extension treatment along the time axis.

An operation for effecting the variation of a reproducing speed by virtue of the DSP 4 will be described in detail below with reference to the accompanying drawings.

At first, description will be given to explain the fundamental specification of the DSP 4 used in the present embodiment. Namely, the DSP 4 is provided to receive, from the memory control micro computer 3, an externally set speed information, an output mode information and a pitch change information, and to receive a digital stereo audio information from the buffer memory 2. Further, the DSP 4 can produce 2-channel output and a new speed information (for reading next audio information) to the memory control micro computer 3.

Namely, the DSP 4 can receive audio information in accordance with a speed information N set at 0.5 to 5 times by the memory control micro computer 3, change the reproducing speed, and produce an output to the D/A converter 5. Further, the DSP 4 produces a speed information M (0.42 to 6.6 times) to the memory control micro computer 3 for reading a next audio information. In fact, the DSP 4 receives (in the form of digital data) audio information from the CD-ROM drive 1, in accordance with a signal of a speed magnification of M (from 44.1 kHz×0.42 to 44.1 kHz×6.6 sampling) of an original signal (44.1 KHz sampling). At this time, the CD-ROM drive 1 can reproduce audio information at a speed magnification of 0.42 to 6.6, and produce 2-channel audio information at a stereo mode or an expansion mode.

Further, by setting externally, it is also possible to perform ±5% pitch adjustment. Specifically, a compression/extension treatment is performed on non-audio data, and it is allowed to send a speed information (0.42 to 6.6 times) to the memory control micro computer 3, in accordance with the level of an input signal. Here, the compression treatment is performed in accordance with the magnitude of the amplitude of an audio signal, eliminating the signals having a level equal to or lower than a certain predetermined value, thus effecting a noise decrement.

In practice, the speed information to be fed to the memory control micro computer 3 is prepared in the form of a table in a memory contained in the DSP 4. Therefore, speed information can be obtained by conducting a search in the table, in accordance with the magnitude (signal component is extracted by a high-pass filter from an original signal of one spacial area, thereby calculating an amplitude) of an amplitude of an audio information read from the CD-ROM drive 1, as well as in accordance with a speed set in advance. Each reproducing speed (to be fed to the memory control micro computer 3) corresponding to a set speed is shown in the table of FIG. 4. Therefore, it is allowed to perform the compression/extension treatment by varying window cutting positions in accordance with the amplitude information. Further, changing tone pitch may be effected by desampling with the use of a preset value.

Figure 2A:
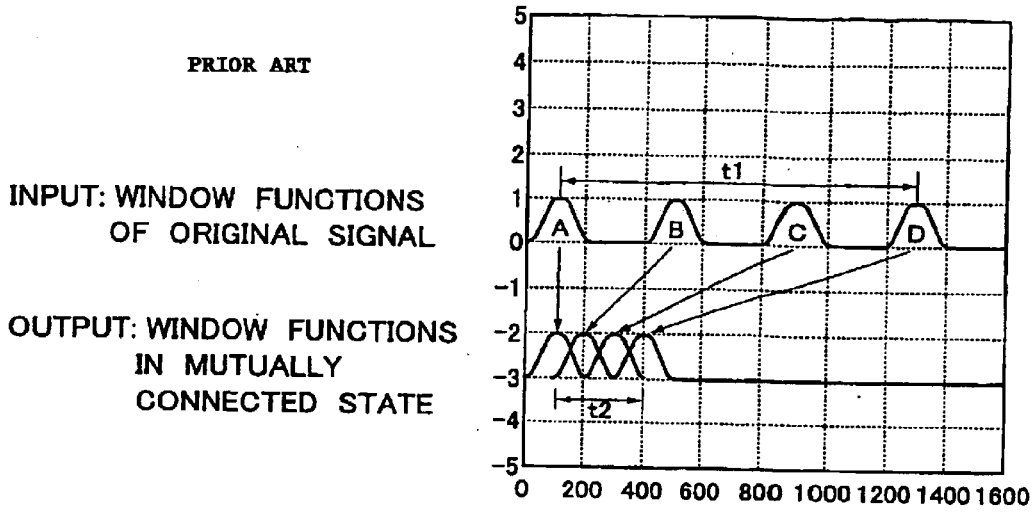
FIG.2 A PRIOR ART
FIGS. 2A and 2B are graphs showing the operation of the above one embodiment, also showing application of window functions when reproducing audio information with speed magnification.
Figure 2B:
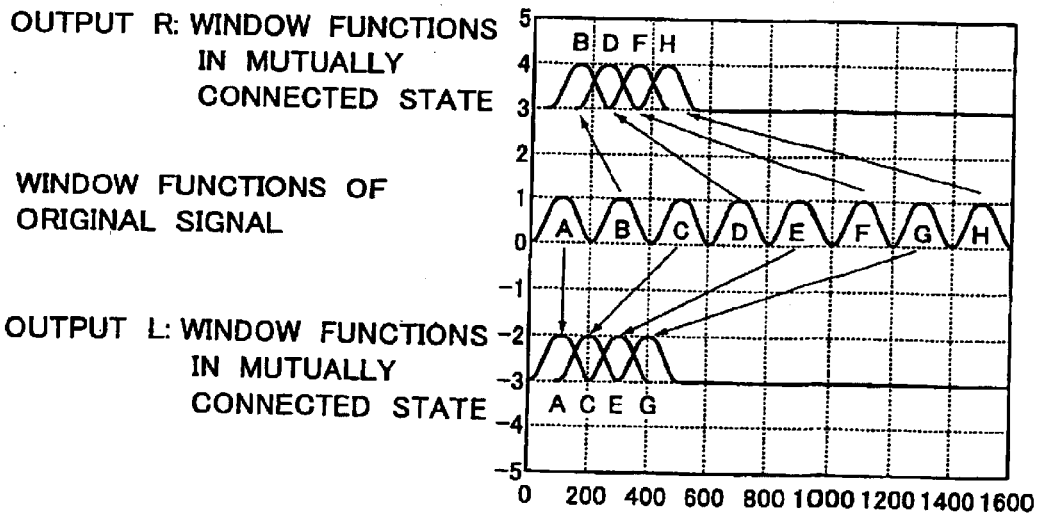

FIGS. 2A and 2B are graphs showing conditions in which several window functions are overlapped by one another when an audio information is reproduced at a speed magnification of 4. In detail, FIG. 2A represents a prior art and FIG. 2B represents the present invention.

In the prior art shown in FIG. 2A, when an audio information is reproduced at a speed magnification of N, a window function is used to cut out segments A, B, C, D (in a time t1) from an original signal. The segments are then overlapped by one another in a time t2, thereby effecting a compression along a time axis. As shown in FIG. 2A, since many data portions are cut away from the original signal, the audio information will become incomplete, rendering it difficult to clearly hear a sound reproduced from an audio information.

Different from the above-described prior art, in the present invention as shown in FIG. 2B, an amount of segments which are twice as many as in the above prior art are cut out, and then converted into left and right signals so as to let a person's right and left ears to hear sounds of different areas. As can be understood from FIG. 2B, with regard to window functions of output R, the centers of segments B, D, F are located in positions corresponding to several positions (of output L), including a position between window functions A and C, a position between window functions C and E and a position between window functions E and G, with a time positional relationship being the same as that of the original signal.

In this way, it is possible to eliminate a time lag between right and left ears of a person when actually hearing a sound. In the following description of the specification, this mode is referred to as "expansion mode" so as to make it more distinguishable from a stereo mode in the prior art. In FIG. 2B, there are shown mutually connected window functions (output L) and mutually connected window functions (output R). At this time, since an information cutting-away amount has been reduced, it is allowed to obtain an improved recognizability for hearing a reproduced sound.

Figure 3:
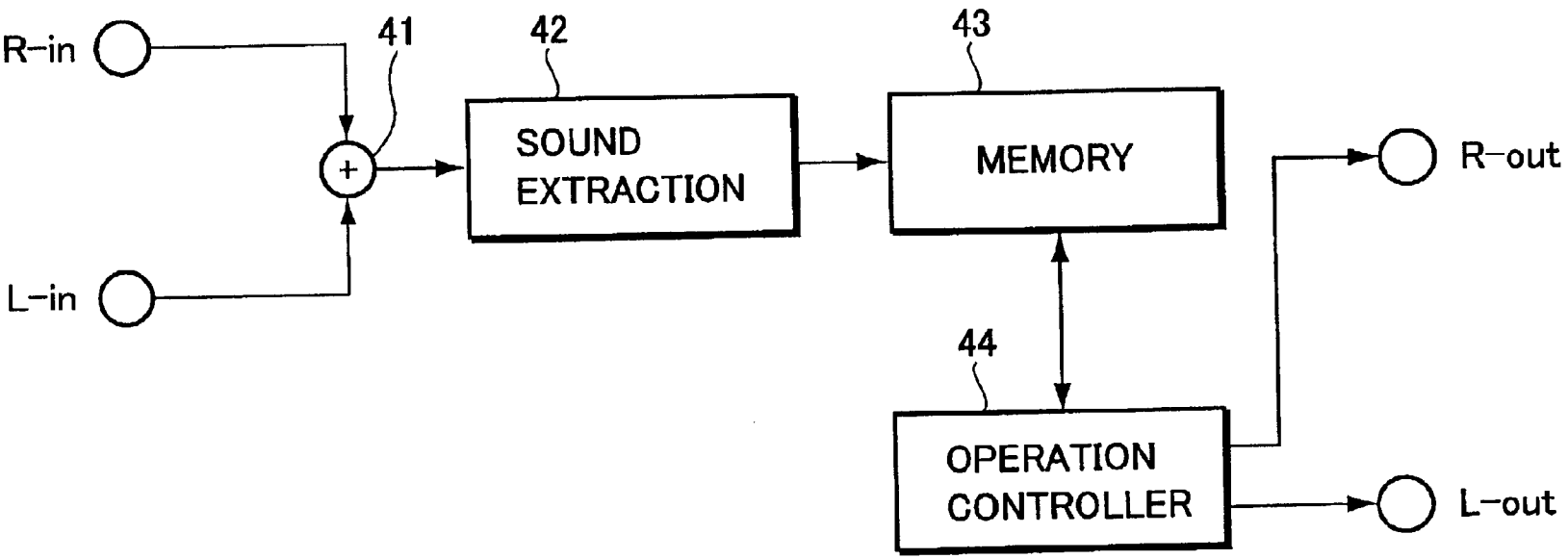
FIG. 3 is a block diagram showing the internal constitution of a DSP.

At this time, the DSP 4 is constituted in a manner shown in FIG. 3. Namely, the DSP 4 has a synthesizing circuit 41 for synthesizing together R (Right) input signal and L (Left) input signal, and has a band-pass filter 42 for extracting a predetermined audio information. The extracted audio information is stored in the internal memory 43, and processed by applying window functions at an interval calculated in an operation controller 44, thereby cutting out segments of audio information. Further, the cut-out segments of the audio information are overlapped by one another and connected together in a way shown in FIG. 2B, thus forming L (Left) and R (Right) independent output audio signals.

Specifically, at each cut-out interval, information data is divided into audio data and non-audio data, depending upon the amplitude of each input signal. When a speed magnification is larger than 1, audio information data is reproduced at a low speed, while non-audio information data is reproduced at a high speed. The operation controller 44 is provided to send the above speed information to the memory control micro controller 3. As one example, the table in FIG. 4 shows that when an externally set speed magnification is 0.5–5, a speed magnification for audio information is 0.7–3, and a speed magnification for non-audio information is 0.42–6.6.

A calculation equation for use in preparing the table of FIG. 4 will be explained in the following. Namely, in order to easily hear a reproduced sound, when a speed magnification is smaller than 1 (reproducing at a low speed), a cut-out interval in small amplitude area is made small (advance at a low speed), while a cut-out interval in large amplitude area is made large (close to a value of 1). With regard to signal amplitude value, if center value is Xmeg, threshold value sh is also made to be Xmeg. If a reproducing speed (when an amplitude is larger than threshold value sh) is made dx1 or a reproducing speed (when an amplitude is smaller than threshold value sh) is made dx2, since an occurrence rate of dx1 and dx2 will become 50%, an initially set speed value k may be indicated in the following equations.

$$1/k=1/(2\times dx1)+1(2\times dx2)$$

Here, when k<1 (when reproducing at a low speed)

$$dx1=0.6\times k+0.4$$

$$dx2=k\times dx1(2\times dx1-1)$$

When reproducing at a high speed (k>1), in order to easily hear a reproduced sound, the cut-out interval in small-amplitude areas is made large (advance at a high speed), while the cut-out interval in small-signal portions is made small (close to a value of 1).

When 1<k<2

$$dx1=0.5\times k+0.5$$

$$dx2=k\times dx1/(2\times dx1-k)$$

When 2<k<3

$$dx1=k-0.5$$

$$dx2=k\times dx1/(2\times dx1-k)$$

When 3<k<4

$$dx1=0.5\times k\times 0.5$$

$$dx2=k\times dx1/(2\times dx1-k)$$

When 4<k<5

$$dx2=6$$

$$dx1=k\times dx2/(2\times dx2-k)$$

Figure 5A:
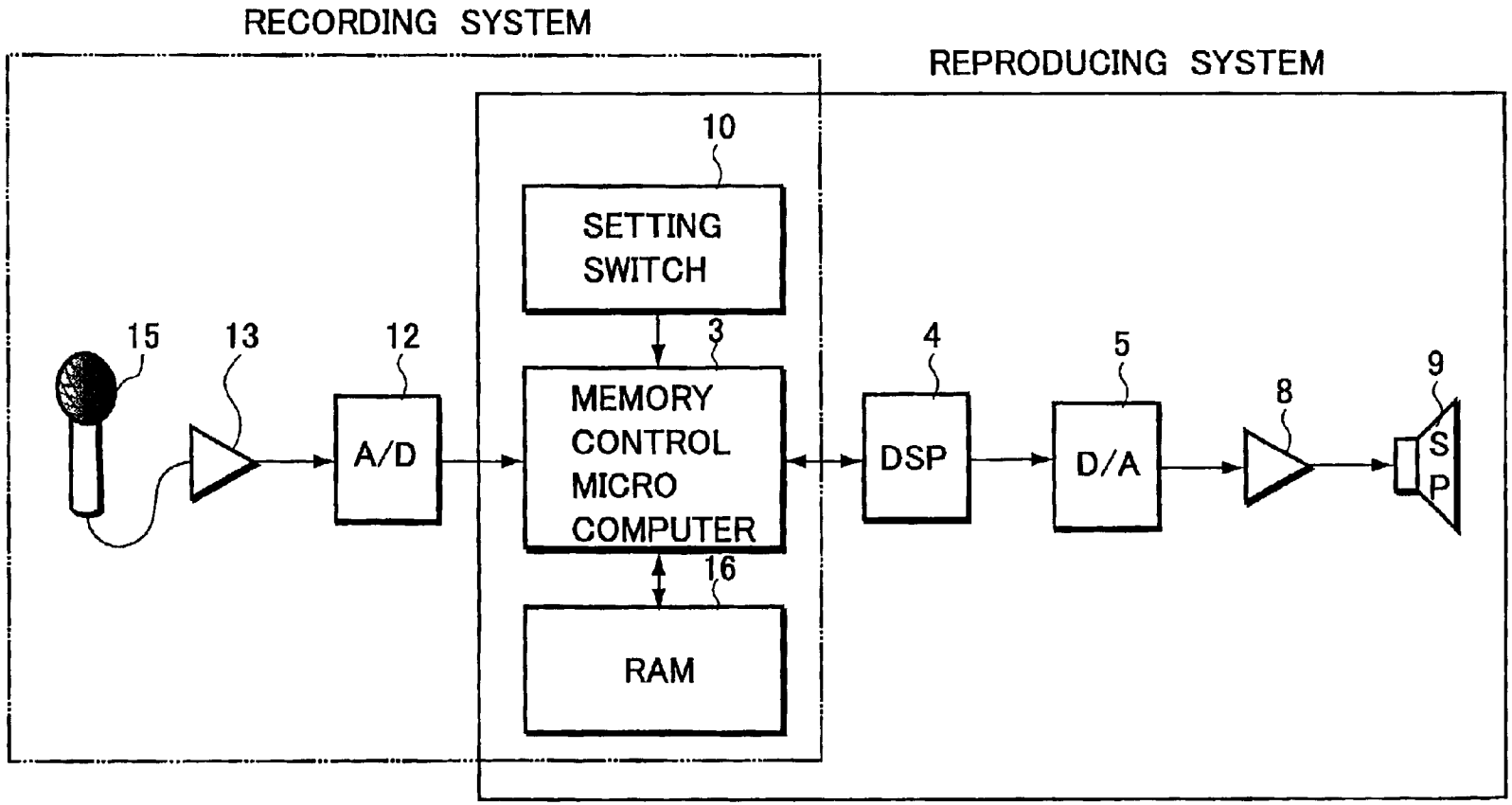
FIGS. 5A and 5B are block diagrams showing examples to which the present invention has been applied.
Figure 5B:
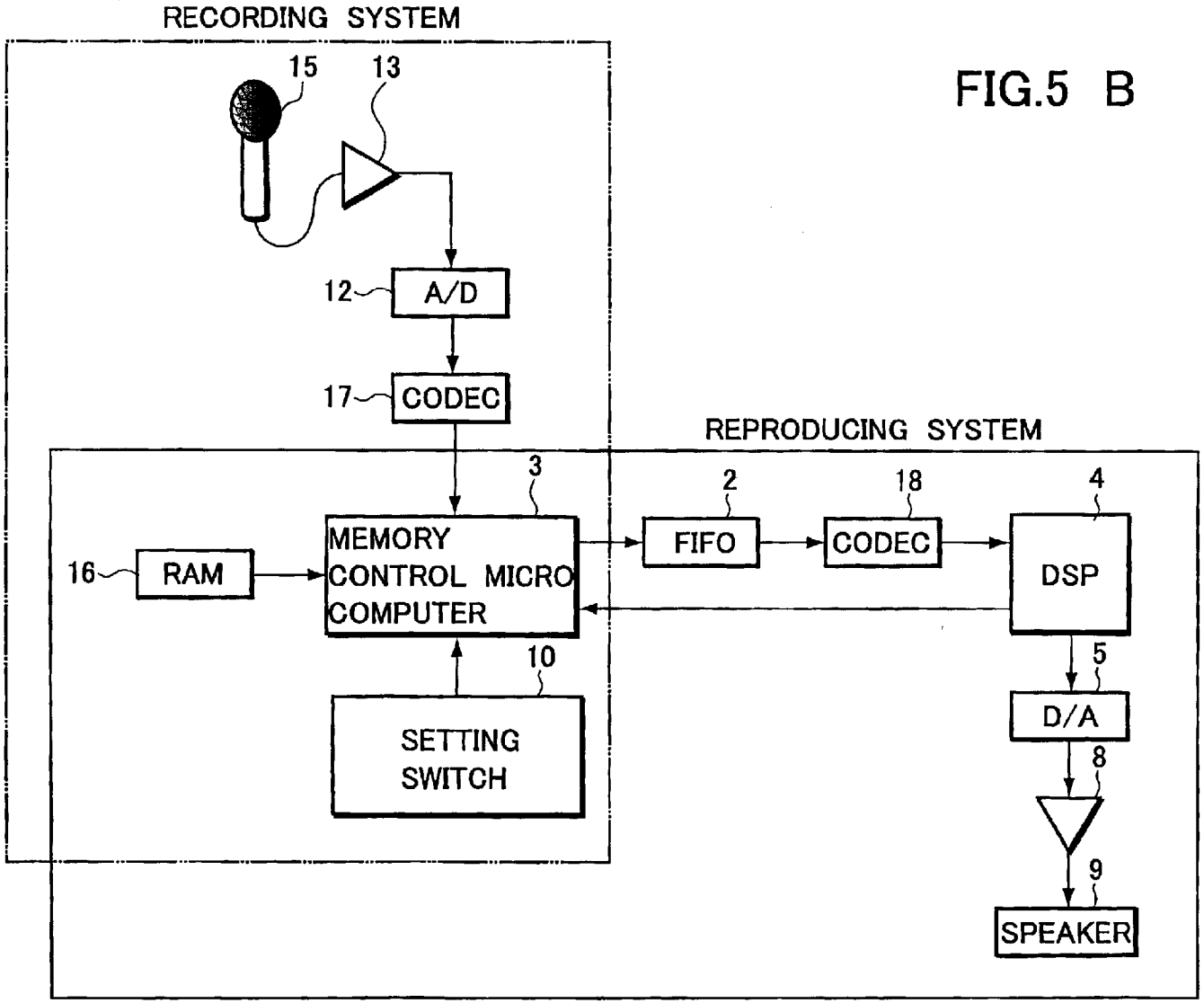
Figure 6:
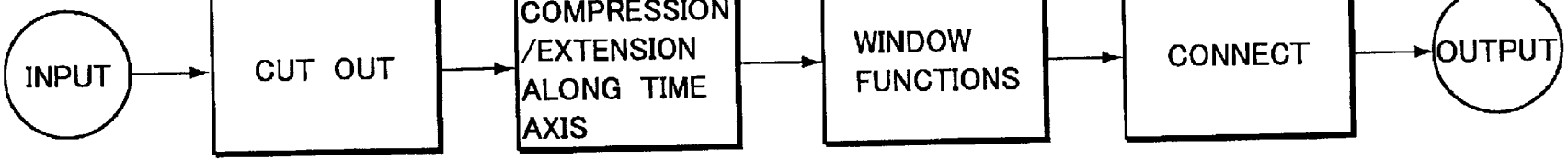
FIG.6 PRIOR ART
FIG. 6 is a block diagram showing a procedure for effecting a reproducing speed conversion by using a conventional audio information reproducing apparatus.

FIGS. 5A and 5B are used to illustrate examples to which the present invention has been applied. In detail, FIG. 5A shows an example using a recording/reproducing source, FIG. 5B shows an example of treating a real time source.

As shown in FIG. 5A, reproduction media may be a CD-ROM drive shown in FIG. 1, a DVD (Digital Versatile Disc), a semiconductor memory, or a magnetic tape. Here, a microphone 15 or an external input terminal (not shown) may be used to incorporate an audio signal such as a talk or a music into the rewritable audio RAM 16. Such an audio signal to be incorporated is at first amplified in an amplifier 13 and then converted in an A/D converter 12, and finally recorded in the RAM 16, thereby enabling the sound source to be reproduced at a variable speed. In more detail, the memory control micro computer 3 operates to store a digitalized audio signal in the audio RAM 16. The digitalized audio signal is then read out at a speed magnification of N set by a setting switch 10, and fed to the DSP 4. The DSP 4 operates to send a speed magnification (which is a speed magnification of M obtained by searching in the above table in accordance with the amplitude of an audio signal) to the memory control micro computer 3 (also sent to it is a transmission request). As a result, it is possible to obtain information data from the memory control micro computer 3 at a speed magnification of M and to reproduce the information data after performing a predetermined conversion of the reproducing speed.

The application of the present invention is suitable for an exercise for improving a person's oral English, i.e., suitable for a process in which an audio data is reproduced first at a low speed and then the reproducing speed is gradually increased. Further, the application of the present invention is suitable for reproducing an IC recorder at a high speed (can save a time such as that necessary for throwing back a question during a lecture), also suitable for an absent telephone, a sing-along system, as well as a social dance exercise. Namely, the present invention is suitable for a process in which an audio data is reproduced first at a low speed and then the reproducing speed is gradually increased, thereby rendering it possible for a person to obtain a high efficiency in hearing a desired sound, thus promoting a desired exercise.

FIG. 5B shows an example in which sound codec is used for saving a memory. As shown in FIG. 5B, CODECs 17 and 18 are provided to perform a compression/extension treatment of an audio signal, within a predetermined time range along a time axis, with the treatment being carried out in frame unit. Referring to FIG. 5B, A/D-converted signal is compressed in the CODEC 17, with 1000 samplings serving as one frame, so that an amount of data is compressed to 1/10 so as to be stored in a memory. At this time, the memory control micro computer 3 operates to send the compressed signal (in accordance with frame unit) to an FIFO memory 2, thereby extending (in the CODEC 18) the audio signal to change it back to its original state, and send it to the DSP 4.

For example, in order to improve the clarity of hearing a television broadcast, a radio broadcast and a cellular telephone, it is desired to reproduce an audio information at a low speed using the present invention. Namely, video data or audio data (being broadcasted) may be recorded in HDD while at the same time making variable a reproducing time, thereby making it possible to reproduce information data while at the same adjusting the reproducing speed. Further, the present invention is suitable for performing a time shift reproducing (a reproducing starting at a time later than recording). If information recording media is image recording media, and if a broadcasting time is 60 minutes, it is possible for the information data to be reproduced during a slightly extended time period (for example, 70 minutes), with non-talking portions being extended. Moreover, with regard to communication through cellular telephone, if it is difficult to understand everything of what said by a person at the other end of the line because he or she talks so fast, the sound data can be stored in a memory, with the talking portions being reproduced at a low speed. At this time, non-talking portions can be shortened. If it is desired to reproduce a television broadcast and at the same time to save time, it is allowed to shorten non-talking portions, so that the television broadcast (for example, 60-minutes) may be reproduced within 50 minutes.

As described in the above, since various sound sources can be reproduced real-timely at a variable speed, it has become possible for a person to exactly hear his or her desired news program of television or radio broadcast, as well as a quick-spoken talk of an announcer (of a TV or radio station) or a person at the other end of a telephone line. Therefore, if such a function obtainable from the present invention is incorporated into a hearing aid device, an elderly person can easily hear his or her desired contents.

According to the present invention described in the above, it has become possible to provide a method of and an apparatus for reproducing an audio information, which can ensure an improved recognizability for hearing a reproduced sound information. In detail, audio information read from an audio information source is at first stored in a buffer memory, the stored audio information is then read out at a preset speed magnification, and reproduced upon receiving a reproducing speed conversion treatment. The method comprises sending a request for reading audio information to the audio information source in accordance with an amount of information accumulated in the buffer memory; reading a predetermined amount of audio information from the buffer memory in accordance with the preset speed magnification, and reproducing the predetermined amount of audio information after performing a reproducing speed conversion treatment on the audio information. Therefore, according to the present invention, it has become possible to reduce an information cutting amount, thus allowing a reduction in the capacity of the buffer memory.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. An audio information reproducing method wherein audio information read from an audio information source is at first stored in a buffer memory, the stored audio information is then read out at a preset speed magnification, and reproduced upon receiving a reproducing speed conversion treatment, said method comprising:

sending a request for reading audio information to the audio information source in accordance with an amount of information accumulated in the buffer memory;

reading a predetermined amount of audio information from the buffer memory in accordance with the preset speed magnification, and reproducing the predetermined amount of audio information after performing a reproducing speed conversion treatment on the audio information.

2. An audio information reproducing method wherein audio information read from an audio information source is at first stored in a buffer memory, the stored audio information is then read out at a preset speed magnification, and reproduced upon receiving a reproducing speed conversion treatment, said method comprising:

successively cutting out, in accordance with window functions, first portions of the audio information, connecting together the first portions, and rendering the mutually connected first portions to serve as an output for converting a reproducing speed in a first channel;

successively cutting out, in accordance with window functions, second portions of the audio information, connecting together the second portions, and rendering the mutually connected second portions to serve as an output for converting a reproducing speed in a second channel; and reproducing the audio information independently through the first and second channels.

3. An audio information reproducing method according to claim 2, wherein the first portions and the second portions of the audio information are variable in their extension/compression rates in accordance with the amplitudes of these portions.

4. An audio information reproducing apparatus comprising:

an audio information source;

a buffer memory for storing audio information read from the audio information source;

speed magnification setting means for setting a reproducing speed magnification for use in reading the audio information stored in the buffer memory; and signal processing means capable of sending a request for reading audio information to the audio information source in accordance with an amount of information accumulated in the buffer memory, reading a predetermined amount of audio information from the buffer memory in accordance with the preset speed magnification, and reproducing the predetermined amount of audio information after performing a reproducing speed conversion treatment on the audio information.

5. An audio information reproducing apparatus comprising:

an audio information source;

a buffer memory for storing audio information read from the audio information source in accordance with a speed magnification; and signal processing means capable of i) cutting out, successively and in accordance with window functions, first portions of the audio information, connecting together the first portions, and rendering the mutually connected first portions to serve as an output for converting a reproducing speed in a first channel, ii) successively cutting out, in accordance with window functions, second portions of the audio information, connecting together the second portions, and rendering the mutually connected second portions to serve as an output for converting a reproducing speed in a second channel, and iii) reproducing the audio information independently through the first and second channels.

* * * * *